US008758041B2

(12) United States Patent
Bishop et al.

(10) Patent No.: US 8,758,041 B2
(45) Date of Patent: Jun. 24, 2014

(54) INSULATION DISPLACEMENT CONNECTOR (IDC)

(75) Inventors: Peter Bishop, Cambs (GB); Norman Huntley, Bishops Stortford (GB)

(73) Assignee: AVX Corporation, Myrtle Beach, SC (US)

( * ) Notice: Subject to any disclaimer, the term of this patent is extended or adjusted under 35 U.S.C. 154(b) by 0 days.

(21) Appl. No.: 13/349,148

(22) Filed: Jan. 12, 2012

(65) Prior Publication Data

US 2013/0164968 A1 Jun. 27, 2013

Related U.S. Application Data

(63) Continuation of application No. 12/827,640, filed on Jun. 30, 2010, now Pat. No. 8,109,783.

(51) Int. Cl.
*H01R 4/24* (2006.01)

(52) U.S. Cl.
USPC ..... 439/404

(58) Field of Classification Search
USPC ..... 439/391, 395–404
See application file for complete search history.

(56) References Cited

U.S. PATENT DOCUMENTS

| | | | |
|---|---|---|---|
| 3,848,954 | A | 11/1974 | Sedlacek |
| 3,854,114 | A | 12/1974 | Kloth et al. |
| 3,985,416 | A | 10/1976 | Dola et al. |
| 4,068,912 | A | 1/1978 | Hudson et al. |
| 4,227,763 | A | 10/1980 | Marks |
| 4,262,985 | A | 4/1981 | Muehlhausen, II |
| 4,533,199 | A | 8/1985 | Feldberg |
| 4,645,285 | A | 2/1987 | Cozzens et al. |
| 4,668,039 | A | 5/1987 | Marzili |
| 4,701,001 | A | 10/1987 | Verhoeven |
| 4,836,803 | A | 6/1989 | Seidel |
| 5,120,244 | A | 6/1992 | Saito et al. |
| 5,188,536 | A | 2/1993 | Ganthier et al. |
| 5,199,896 | A | 4/1993 | Mosquera |

(Continued)

FOREIGN PATENT DOCUMENTS

| | | |
|---|---|---|
| DE | 27 47 395 | 12/1979 |
| DE | 31 08 931 | 11/1982 |

(Continued)

OTHER PUBLICATIONS

Jaycar Electronics Reference Data Sheet: IDCONNJ.PDF (1) "IDC Cable, Headers, & Connectors", 2004.

(Continued)

*Primary Examiner* — Khiem Nguyen
(74) *Attorney, Agent, or Firm* — Foley & Lardner LLP

(57) ABSTRACT

An electrical insulation displacement connector includes a bare single-wire contact element having a first end defined by opposed blades that define a receipt aperture for an insulated wire, and a second end configured for direct electrical contact at a contact position on a printed circuit board. Retaining structure is defined on the blades. A cap is configured for fitting over the exposed bare blades. The cap includes side walls and end walls with a slot defined in each of he end walls that align with the blade aperture. The side walls are engaged by the retaining structure upon pressing the cap onto the blades. The slots in the end walls of the cap have a width and height such that upon fully pressing the cap onto the blades, the slots engage and longitudinally align the insulated wire into the blade aperture so that the blades pierce and make electrical contact with a core in the insulated wire.

20 Claims, 4 Drawing Sheets

(56) References Cited

U.S. PATENT DOCUMENTS

| | | | |
|---|---|---|---|
| 5,415,562 | A | 5/1995 | Matsumoto et al. |
| 5,478,248 | A | 12/1995 | Mitra et al. |
| 5,549,484 | A | 8/1996 | Chen |
| 5,551,889 | A | 9/1996 | Kozel et al. |
| 5,577,930 | A | 11/1996 | Dahlem et al. |
| 5,616,047 | A | 4/1997 | Lutsch |
| 5,997,337 | A | 12/1999 | Torii |
| 6,007,366 | A | 12/1999 | Torii et al. |
| 6,019,637 | A | 2/2000 | Iwata et al. |
| 6,050,845 | A | 4/2000 | Smalley, Jr. et al. |
| 6,093,048 | A | 7/2000 | Arnett et al. |
| 6,135,821 | A | 10/2000 | Liu |
| 6,285,815 | B1 | 9/2001 | Daoud |
| 6,837,737 | B2 | 1/2005 | Baier et al. |
| 6,965,671 | B2 | 11/2005 | Kao et al. |
| 7,309,252 | B2 | 12/2007 | Fabian et al. |
| 7,320,616 | B1 | 1/2008 | Legrady et al. |
| 7,503,797 | B2 | 3/2009 | Lappoehn |
| 7,780,468 | B1 | 8/2010 | Bishop |
| 7,833,045 | B2 | 11/2010 | Bishop |
| 7,931,489 | B2 | 4/2011 | Bishop |
| 7,976,334 | B2 | 7/2011 | Bishop |
| 8,109,783 | B2 | 2/2012 | Bishop et al. |
| 8,192,223 | B2 | 6/2012 | Bishop |
| 8,262,405 | B1 | 9/2012 | Bishop |
| 2012/0322294 | A1 | 12/2012 | Lappoehn |

FOREIGN PATENT DOCUMENTS

| | | |
|---|---|---|
| DE | 29 12 882 | 2/1983 |
| DE | 36 27 333 | 2/1988 |
| DE | 40 30 480 | 4/1992 |
| DE | 40 30 482 | 4/1992 |
| DE | 41 08 133 | 8/1994 |
| DE | 101 42 363 | 3/2003 |
| DE | 2020060 14 893 | 12/2006 |
| EP | 0 211 191 | 2/1987 |
| EP | 0 228 750 | 7/1987 |
| EP | 0 411 859 | 2/1991 |
| EP | 0 834 957 | 4/1998 |
| EP | 0 895 309 | 2/1999 |
| FR | 2626124 | 4/1994 |
| FR | 2768561 | 11/1999 |
| GB | 2 058 485 | 4/1981 |
| JP | 39-010621 | 6/1939 |
| JP | 4136875 U1 | 12/1992 |
| JP | 11-329575 | 11/1999 |
| JP | 2004-111364 | 4/2004 |
| JP | 2011-044259 | 3/2011 |
| KR | 20050034465 | 4/2005 |

OTHER PUBLICATIONS http://www.etco.com/Releases: Press Release:"IDC Terminals Provide One-Step Attachment", 2006.

HTTP://www.wppltd.demon.co.uk/V\pp/wiring/uktelephone/installation/installation.HTML: Tools & Installation: Tols, Feb. 24, 2008.

UK Patent Office Search Report, Oct. 11, 2011.

Related U.S. Appl. No. 13/407,938, filed Feb. 29, 2012.

INSULATION DISPLACEMENT CONNECTOR (IDC)

CROSS-REFERENCE TO RELATED APPLICATION

The present application is a Continuation Application of U.S. patent application Ser. No. 12/827,640, filed Jun. 30, 2010.

FIELD OF THE INVENTION

The present invention relates generally to the field of electrical connectors, and more particularly to insulation displacement connectors (IDC) used to connect one or more insulated wires to a component, such as a printed circuit board (PCB).

BACKGROUND

Insulation displacement connectors (IDC) are well known in the art for forming connections between an insulated wire and any manner of electronic component. These connectors are typically available as sockets, plugs, and shrouded headers in a vast range of sizes, pitches, and plating options. A common feature of IDC's is one or more contact elements incorporating a set of blades or jaws that cut through the insulation around the wire and make electrical contact with the conductive core in a one-step process, thus eliminating the need for wire stripping and crimping, or other wire preparation. IDC's are used extensively in the telecommunications industry, and are becoming more widely used in printed circuit board (PCB) applications.

Conventional IDC's typically include a housing or base member that is formed of a non-conductive material and defines a passage or channel for receipt of the wire in the housing member. The contact elements are molded, pressed, or otherwise engaged in the housing member along the passage or channel. A common feature is generally some type of engaging or retaining structure defined in the housing member that serves to ensure that the wires are not inadvertently dislodged or pulled from the connector due to vibration or other reasons. Reference is made to U.S. Pat. Nos. 5,997,337; 5,577,930; and 5,188,536.

U.S. Pat. No. 6,050,845 describes an IDC assembly that includes a housing having at least one conductor-receiving aperture and an associated terminal-receiving passageway extending from a board mounting face and intersecting each conductor-receiving aperture. A terminal is disposed in each terminal-receiving passageway and includes a body portion having a first connecting section extending from one end and adapted to be inserted in a through-hole of a circuit board, and a pair of upstanding arms defining an IDC slot for receipt of a wire. Each terminal is partially inserted into the housing in a first position such that a portion of the terminal body and the first connecting section extends below the board mounting face of the housing. Upon positioning the first connecting sections in corresponding through-holes of a circuit board, the terminals can be secured to the board, after which ends of insulated conductors can be inserted into respective conductor-receiving apertures and terminated therein to respective terminals by moving the housing toward the board to a second position against the board and simultaneously pushing all the corresponding wires into respective IDC slots.

Attempts have been made to configure IDC's for surface mounting technology (SMT) applications as well. For example, U.S. Pat. No. 7,320,616 describes an IDC specifically configured for SMT mounting to a PCB. The connector assembly has at least one contact member with a piercing, cutting or slicing end that is slideably disposed within a main body, and a mounting end that extends from the main body and is attached to a printed circuit board using conventional SMT processes. An insulated conductor, such as a wire, cable and/or ribbon, is inserted in a channel in the main body without being pierced by the piercing end of the contact. When a user pushes down on the top portion of the main body, the contact slides into the channel and pierces the insulated conductor. The top portion of the main body also provides a surface for a vacuum pick-up nozzle in an automated pick-and-place assembly process.

As electronic components become smaller and smaller, the space ("real estate") on the circuit boards becomes increasingly more valuable and, in this regard, the housing members of conventional multi-wire IDC's tend to waste precious space on the boards. In addition, the shape and configuration of the typical contact/housing component limits placement and orientation of the connector on the board, which limits the number of wire connections that could otherwise be made on a smaller contact footprint or pad.

The present invention provides an improved IDC design that is rugged, space-efficient, and particularly well suited for single, individual wire connections at any desired pitch and orientation on a circuit board.

SUMMARY

Objects and advantages of the invention will be set forth in part in the following description, or may be obvious from the description, or may be learned through practice of the invention.

In accordance with aspects of the invention, an electrical insulation displacement connector (IDC) is provided that is particularly well suited for connecting individual insulated conductive core wires to a printed circuit board (PCB). The connector takes up minimal space on the board and a plurality of the connectors may be used to connect multiple wires at various angles and orientations in a space on the board that otherwise could not accommodate the wires. It should be appreciated, however, that connectors according to the invention are not limited to this use.

A particular embodiment of a connector in accordance with the invention includes a "bare," single-wire contact element having a first end defined by opposed blades that define a receipt aperture for an insulated wire. The element includes a second end that is configured for direct electrical contact at a contact position on the PCB. The contact element is "bare" in that it is not contained within or surrounded by a housing or other type of base structure, but is completely exposed on the PCB. Retaining structure is defined on the blades and, in a particular embodiment, this structure may be barbs or other positive locking-type structure. A cap is configured for fitting over the opposed bare blades and includes side walls and end walls with a slot defined therein that align with the blade aperture. The side walls are engaged by the retaining structure on the blades upon pressing the cap onto the blades. The slots in the end walls of the caps have a width and height such that upon fully pressing the cap onto the blades, the slots engage and longitudinally align the insulated wire into the blade aperture so that the blades pierce and make electrical contact with the conductive core in the insulated wire.

The connector may include a single pair of the opposed blades, or multiple spaced-apart pairs of blades. For example, in a particular embodiment, two spaced apart pairs of the blades are provided, with the cap configured to fit over both pairs of blades. In this embodiment, the cap may further include an internal longitudinally extending boss disposed to engage the insulated wire between the pairs of opposed blades at the fully pressed-on position of the cap.

The connector may be configured for thru-hole connection at the contact position on the PCB or surface mount connection.

The present invention also encompasses a PCB assembly that includes one or more of the connectors discussed herein. For example, this assembly may include a printed circuit board having a contact pad or through-hole footprint defined thereon. At least one of the electrical insulation displacement connectors discussed above is mounted on the PCB. A plurality of the single wire connectors may be provided at the same contact position (i.e., contact pad) for connecting multiple wires at different orientations to the same pad.

Particular embodiments of the unique insulation displacement connectors are described in greater detail below by reference to the examples illustrated in the drawings.

DETAILED DESCRIPTION

Reference will now be made to embodiments of the invention, one or more examples of which are illustrated in the figures. The embodiments are provided by way of explanation of the invention, and are not meant as a limitation of the invention. For example, features illustrated or described as part of one embodiment may be used with another embodiment to yield still a further embodiment. It is intended that the present invention encompass these and other modifications and variations as come within the scope and spirit of the invention.

Figure 1:
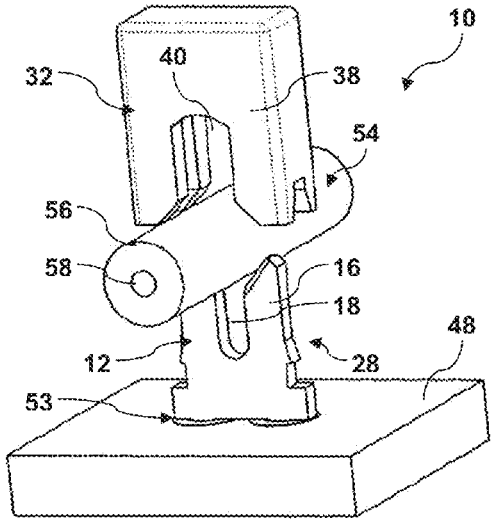
FIG. 1 is a perspective view of an embodiment of a connector according to the invention mounted onto a circuit board.

FIG. 1 is a perspective view of an embodiment of an insulation displacement connector 10 in accordance with aspects of the invention. The connector 10 is, in this particular embodiment, intended to connect a single insulated core wire 54 to a contact position 53 on a circuit board 48. The wire 54 includes an outer sheath 56 of insulation material surrounding a conductive core 58. The connector 10 makes electrical contact with the core 58 and the circuit board 48 at the contact position 53. The connector 10 includes a bare single-wire contact element 12. As described above, the contact element 12 is "bare" in that it is not contained or surrounded by any manner of housing, base, or other insulative member. When the contact element 12 is attached at the contact position 53 of the circuit board 48, the contact element 12 is completely exposed.

The contact element 12 includes a first end 14 (FIG. 2) that is configured for piercing the insulation material 56 around the core 58 of the wire 54 and making electrical contact with the core 58. In this regard, the first end 14 in the illustrated embodiment includes a pair of opposed blades 16 that define a receipt aperture 18 therebetween. The aperture 18 has a width that corresponds generally to the width of the core 58 for the particular wire gage that the connector 10 is sized for. Upon insertion of the wire 54 into the aperture 18, the blades 16 pierce through the insulation material 56 and come into frictional electrical contact with the core 58, as is commonly understood in the art.

The contact element 12 includes a second end 20 (FIG. 2) that is configured for direct electrical contact with the PCB 48. For example, in the embodiment depicted in FIGS. 1 through 4, the connector 10 is a thru-hole mount connector wherein the contact element 12 includes contact prongs 22 that fit into thru-holes defined in the board 48, as is well understood by those skilled in the art and need not be described in detail herein.

Figure 5:
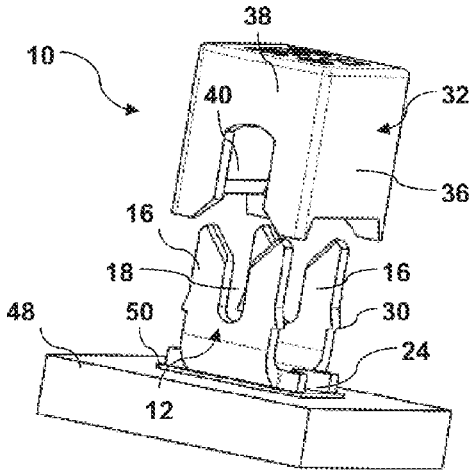
FIG. 5 is a perspective view of an alternative embodiment of a connector according to aspects of the invention.
Figure 6:
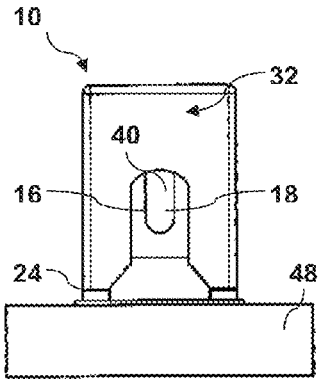
FIG. 6 is an end view of the embodiment of FIG. 5.
Figure 7:
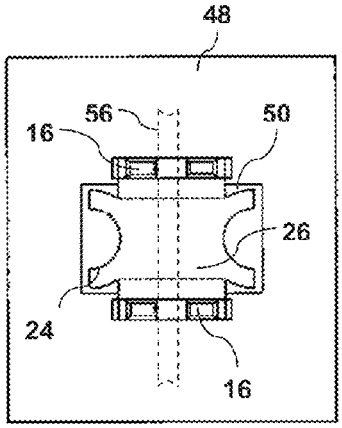
FIG. 7 is a top view of the contact element of the embodiment of FIG. 5 mounted on a circuit board.

In an alternative embodiment, the connector 10 is configured for surface mounting to a pad 50 (FIGS. 5-7). In this embodiment, the contact element 12 may include feet 24 or other members configured for flush surface mounting and soldering onto a conductive pad 50 disposed at the contact position 53 on the circuit board 48, as is commonly understood by those skilled in the art.

The connector 10 includes retaining structure, generally 28, defined on one or both of the blades 16. This retaining structure 28 is designed to positively engage with a cap member 32 that is fitted over the blades 16 so as to secure the cap 32 relative to the blades 16 and prevent inadvertent dislodgement of the cap. In the embodiment illustrated in the figures, the retaining structure 28 is defined by barbs 30 defined on the outer edges of the blades 16.

Referring to the various figures in general, the cap 32 has dimensions so as to fit over the contact element 12, particularly the blades 16. In the illustrated embodiment, the cap 32 is a generally hollow rectangular box-like structure having a top wall 34, side walls 36, and end walls 38. A slot 40 is defined in each of the opposite end walls 38 and is disposed so that when the cap 32 is pressed onto the blades 16, the slot 40 aligns with the aperture 18 in the blades, as particularly illustrated in FIG. 6. The slots 40 have a width and a height such that upon fully pressing the cap 32 onto the blades 16, the slots 40 engage and longitudinally align the insulated wire 54 into the aperture 18 so that the blades 16 pierce the insulation material 56 and make electrical contact with the core 58 of the wire 54. It should be appreciated that the slots may have various shapes and configurations. In the illustrated embodiment, the slots 40 are depicted as generally elongated U-shaped openings having inclined faces 46 (FIG. 3) to aid in initial engagement and alignment of the wire 54 within the slots 40.

The contact element 12 may have various configurations. For example, in the embodiment illustrated in FIG. 1, the contact element 12 includes a single pair of opposed blades 16 and the cap 32 is correspondingly sized to enclose the single pair of blades. In an alternate embodiment illustrated for example in FIGS. 5 through 8, the contact element 12 includes at least two pairs of opposed blades 16. Each set of blades 16 defines an aperture 18 and the apertures 18 are aligned so that the wire 54 passes straight through the apertures and slots 40 in the cap member 32. The alignment of these components is particularly illustrated in FIGS. 6 and 7.

In the embodiments wherein the contact element 12 includes at least two pairs of opposed blades 16, the contact element 12 may be surface mounted onto a contact pad 50, as discussed above and illustrated in FIGS. 5 through 7. The blades 16 may extend upwardly from a common base 26 that includes outwardly extending feet 24. The feet 24 and base 26 may be soldered onto the surface of he contact pad 50.

Figure 8:
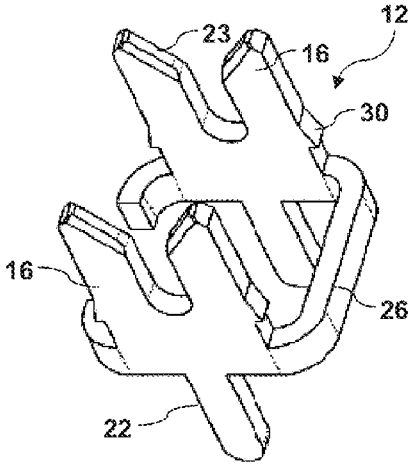
FIG. 8 is a perspective view of an alternative embodiment of a contact element according to the invention.

In the thru-hole mount embodiment of FIG. 8, the contact element 12 has two sets of opposed blades 16 connected to a common perimeter base 26. The contact prongs extend from the bottom of the base 26 at each of the sets of blades 16.

Figure 2:
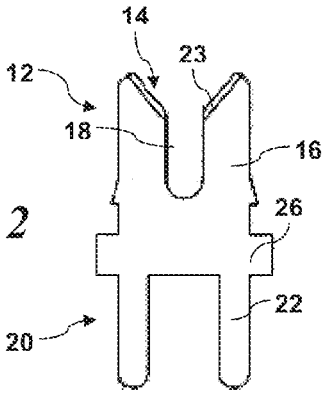
FIG. 2 is a view of the contact element from the embodiment of FIG. 1.
Figure 3:
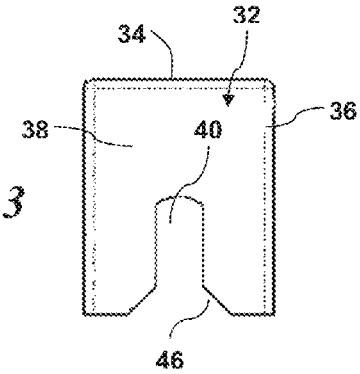
FIG. 3 is an end view of the cap member from the embodiment of FIG. 1.
Figure 4:
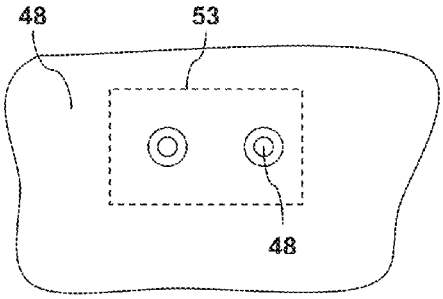
FIG. 4 is a top view of the contact position on the circuit board from the embodiment of FIG. 1.

As particularly illustrates in FIGS. 2 and 8, the opposed blades 16 may also include inclined faces 23 that serve to initially align the wire 54 into the aperture 18.

Figure 9:
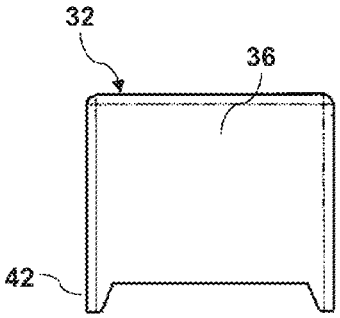
FIG. 9 is a side view of an embodiment of a cap member.
Figure 10:
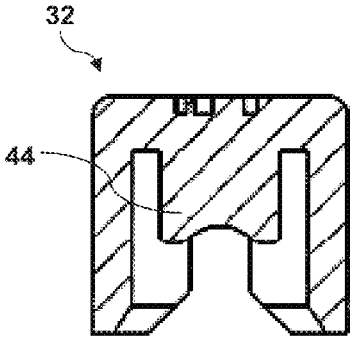
FIG. 10 is an end cut-away view of a cap member.
Figure 11:
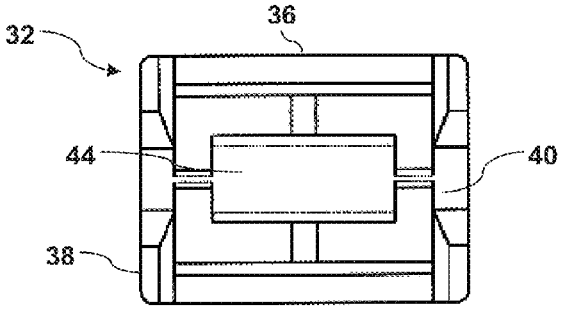
FIG. 11 is a bottom view of the cap member of FIG. 10.

FIGS. 9 through 11 illustrate a particular embodiment of the cap member 32 that may be utilized with a contact element 12 having multiple sets of opposed blades 16. In this particular embodiment, the cap member 32 includes an internal longitudinally oriented boss 44 that is aligned with the slots 40 defined in the end walls 38 of the cap 32. The boss 44 serves to contact the wire 54 between the opposed set of blades and to push the wire 54 down in between the blades 16 as the cap 32 is press fitted onto the blades 16. This configuration ensures a relatively straight, linear disposition of the wire 54 through the connector assembly 10.

Figure 12:
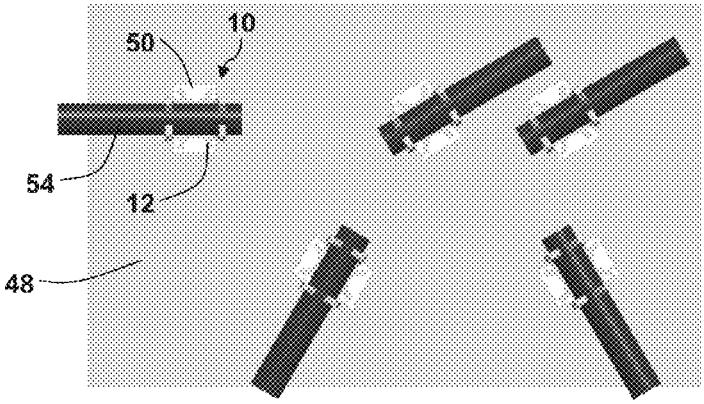
FIG. 12 is a diagrammatic view of a plurality of single wire connectors according to the invention mounted onto a common pad on a circuit board.

FIG. 12 is a top view of a portion of a circuit board 48 having a plurality individual wires 54 mounted in relatively close proximity on the board 48 with respective 10 (contacts 12 without caps 32). The contacts 10 can be mounted at any position and orientation on the board 48, thereby providing a more flexible layout with minimal board space. In this embodiment, individual respective contact pads 50 are associated with each connector 10 and generally match the size and orientation of the contacts 12. The individual contact pads 50 may be linked together so as to operationally define a single contact pad 50 with multiple wires 54 connected thereto with connectors 10 in accordance with the present invention.

Figure 13:
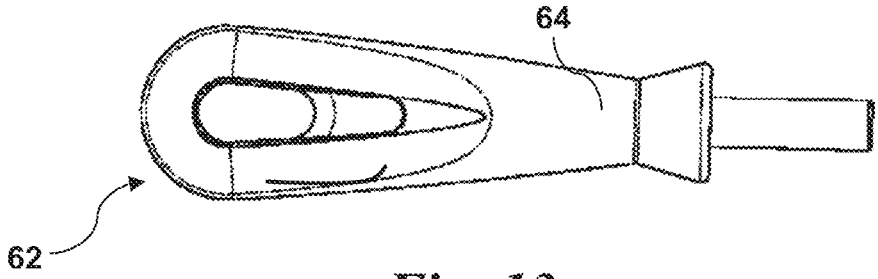
FIG. 13 is a perspective view of a hand tool that may be used with connectors in accordance with aspects of the invention.
Figure 14:
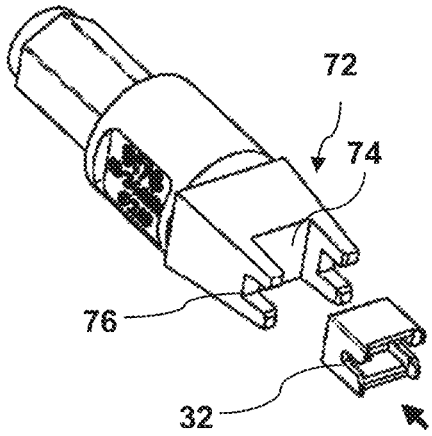
FIG. 14 is a perspective view of a bit that may be attached to the hand tool of FIG. 13 for insertion of a cap member over a contact element.
Figure 15:
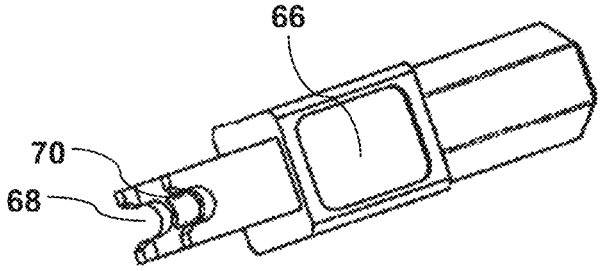
FIG. 15 is a perspective view of a bit that may be attached to the hand tool of FIG. 13 for insertion of an insulated wire into a contact element.

Insulated wires may be inserted into connectors 10 in accordance with aspects of the invention by different methods. A relatively simple process involves the use of a hand tool 62 (FIG. 13). The hand tool 62 includes a handle 64 that may accept a bit 72 (FIG. 14) that is particularly configured for press-fitting a cap 32 (with wire) onto a contact element 12 that has been previously mounted onto a circuit board 48. The bit 72 includes slots 76 and a recess 74 into which the cap 32 is fitted. With this particular tool, the wire 54 and cap 32 can be fitted to the contact element 12 in a single step. FIG. 15 depicts a bit 66 that is configured for pressing a wire into the aperture 18 between opposed blades 16 and, in this regard, includes slots 68 and internal boss 70 for engaging and pressing the wire in a straight linear path between opposed pairs of blades 16.

It should be understood that the contact element 12 may be used as a stand-alone connector without the cap 32 in accordance with further aspects of the invention. Although the cap 32 serves various useful purposes, it certain embodiments, the cap 32 may be not be necessary, particularly where space on the circuit board is insufficient to accommodate the cap 32. Thus, use of the bare contact element 12 mounted directly on the circuit board 48 to connect a wire 54 to a contact position 53 on the board 48 without the cap 32 is within the scope and spirit of the invention.

It should be readily appreciated by those skilled in the art that various modifications and variations can be made to the embodiments of the invention illustrated and described herein without departing from the scope and spirit of the invention. It is intended that such modifications and variations be encompassed by the appended claims.

What is claimed is:

1. An electrical insulation displacement connector, comprising:

a contact element having a first end defining a receipt aperture for an insulated wire, and a second end configured for electrical contact with a printed circuit board (PCB);

a retaining structure defined on said first end; and a cap configured to fit over said first end, said cap having a slot defined therein that aligns with said receipt aperture, said cap engaged by said retaining structure upon pressing said cap over said first end;

wherein said slot has a width and height such that upon pressing said cap over said first end, said slot engages and longitudinally aligns the insulated wire into said receipt aperture so that said first end makes electrical contact with a core in the insulated wire.

2. The connector as in claim 1, wherein said first end comprises opposed blades defining said receipt aperture, said retaining structure defined on said blades.

3. The connector as in claim 2, wherein said contact element comprises a single pair of said opposed blades.

4. The connector as in claim 2, wherein said contact element comprises at least two spaced apart pairs of said opposed blades.

5. The connector as in claim 1, wherein said cap comprises side walls and end walls, said slot defined in said end walls, said side walls engaged by said retaining structure.

6. The connector as in claim 5, wherein said cap further comprises an internal longitudinally extending boss disposed to engage the insulated wire at a filly pressed-on position of said cap.

7. The connector as in claim 6, wherein said first end comprises spaced apart pairs of opposed blades defining said receipt aperture, said boss engaging the insulated wire between said pairs of opposed blades.

8. The connector as in claim 1, wherein said retaining structure comprises barbs defined on said first end.

9. The connector as in claim 1, wherein said second end of said contact element comprises prongs for insertion into thru-holes in the PCB.

10. The connector as in claim 1, wherein said second end of said contact element comprises a foot configured for surface mounting to a pad on the PCB.

11. A printed circuit board assembly, comprising:

a printed circuit board (PCB) having a contact position defined thereon; and an electrical insulation displacement connector mounted on said PCB at said contact position, said connector further comprising:

a contact element having a first end defining a receipt aperture for an insulated wire, and a second end configured for electrical contact with said PCB;

a retaining structure defined on said first end; and a cap configured to fit over said first end, said cap having a slot defined therein that aligns with said receipt aperture, said cap engaged by said retaining structure upon pressing said cap over said first end;

wherein said slot has a width and height such that upon pressing said cap over said first end, said slot engages and longitudinally aligns the insulated wire into said receipt aperture so that said first end makes electrical contact with a core in the insulated wire.

12. The assembly as in claim 11, wherein said first end comprises opposed blades defining said receipt aperture, said retaining structure defined on said blades.

13. The assembly as in claim 12, wherein said contact element comprises a single pair of said opposed blades.

14. The assembly as in claim 12, wherein said contact element comprises at least two spaced apart pairs of said opposed blades.

15. The assembly as in claim 11, wherein said cap comprises side walls and end walls, said slot defined in said end walls, said side walls engaged by said retaining structure.

16. The assembly as in claim 15, wherein said cap further comprises an internal longitudinally extending boss disposed to engage the insulated wire at a fully pressed-on position of said cap.

17. The assembly as in claim 16, wherein said first end comprises spaced apart pairs of opposed blades defining said receipt aperture, said boss engaging the insulated wire between said pairs of opposed blades.

18. The assembly as in claim 11, wherein said contact position comprises a that-hole connection, said second end of said contact element comprising prongs for insertion into thru-holes in said PCB at said contact position.

19. The assembly as in claim 11, wherein said contact position comprises a surface mount pad, said second end of said contact element comprising a foot configured for surface mounting to said pad on said PCB at said contact position.

20. The connector as in claim 1, wherein said cap has a plurality of slots configured to engage and longitudinally align the insulated wire.

* * * * *